US005947873A

United States Patent [19]

Sands et al.

[11] Patent Number: 5,947,873

[45] Date of Patent: Sep. 7, 1999

[54] CLIMBER WITH A SWIVEL HANDLEBAR UNIT

[76] Inventors: Leonard Sands, 4555 Reseda Blvd., Tarzana, Calif. 91356; Johnson Kuo, 5F., No. 6, Lane 12, Sec. 6, Hsin I Rd., Taipei, Taiwan

[21] Appl. No.: 09/071,955

[22] Filed: May 5, 1998

[51] Int. Cl.[6] ..... A63B 22/14

[52] U.S. Cl. ..... 482/52; 482/146; 482/147; 482/53

[58] Field of Search ..... 482/147, 146, 482/111, 52, 53, 51, 79, 80, 148, 112

[56] References Cited

U.S. PATENT DOCUMENTS

| | | | |
|---|---|---|---|
| 4,390,180 | 6/1983 | Simjian | 482/131 |
| 4,391,441 | 7/1983 | Simjian | 482/131 |
| 4,830,362 | 5/1989 | Bull | 482/53 |
| 5,453,065 | 9/1995 | Lien | 482/52 |
| 5,545,111 | 8/1996 | Wang | 482/147 X |
| 5,628,709 | 5/1997 | Chen | 482/53 |
| 5,645,512 | 7/1997 | Yu | 482/53 |
| 5,676,623 | 10/1997 | Yu | 482/53 |
| 5,749,809 | 5/1998 | Lin | 482/52 |
| 5,800,313 | 9/1998 | Yu | 482/53 |

*Primary Examiner*—Richard J. Apley
*Assistant Examiner*—William LaMarca
*Attorney, Agent, or Firm*—Varndell Legal Group

[57] ABSTRACT

A climber includes a driven bar revolvably supported in an upright support frame on a base frame and turned back and forth when two pedal bars are alternatively stepped up and down, a swivel holder revolvably supported on the driven bar and spaced between the upright support frame and a control block at the top of the driven bar to hold a handlebar unit, and an adjustment bar mounted in the swivel holder and moved between a first position where the swivel holder is turned with the driven bar, a second position where the swivel holder can be freely turned about the driven bar, and a third position where the swivel holder is fixed to the upright support frame.

2 Claims, 9 Drawing Sheets

CLIMBER WITH A SWIVEL HANDLEBAR UNIT

BACKGROUND AND SUMMARY OF THE INVENTION

The present invention relates to a climber, and more particularly to a collapsible climber which provides three operation modes to effectively exercise the legs and the waist.

A variety of climbers with functions to exercise the waist have been disclosed, and have appeared on the market. Exemplars are seen in U.S. Pat. Nos. 5,545,111; 5,453,065. However, these climbers are commonly heavy and not collapsible, and provide only the designed functions that can not be optionally controlled.

According to one aspect of the present invention, the climber comprises a driven bar revolvably supported in an upright support frame on a base frame and turned back and forth when two pedal bars are alternatively stepped up and down, a swivel holder revolvably supported on the driven bar and spaced between the upright support frame and a control block at the top of the driven bar to hold a handlebar unit, and an adjustment bar mounted in the swivel holder and moved between a first position where the swivel holder is turned with the driven bar, a second position where the swivel holder can be freely turned about the driven bar, and a third position where the swivel holder is fixed to the upright support frame. According to another aspect of the present invention, the upright support frame is collapsibly pivoted to the base frame and locked by a lock screw, and the handlebar unit is comprised of a holding collapisble handlebar pivoted to the swivel holder and locked by a lock screw.

DETAILED DESCRIPTION OF THE PREFERRED EMBODIMENT

Figure 1:
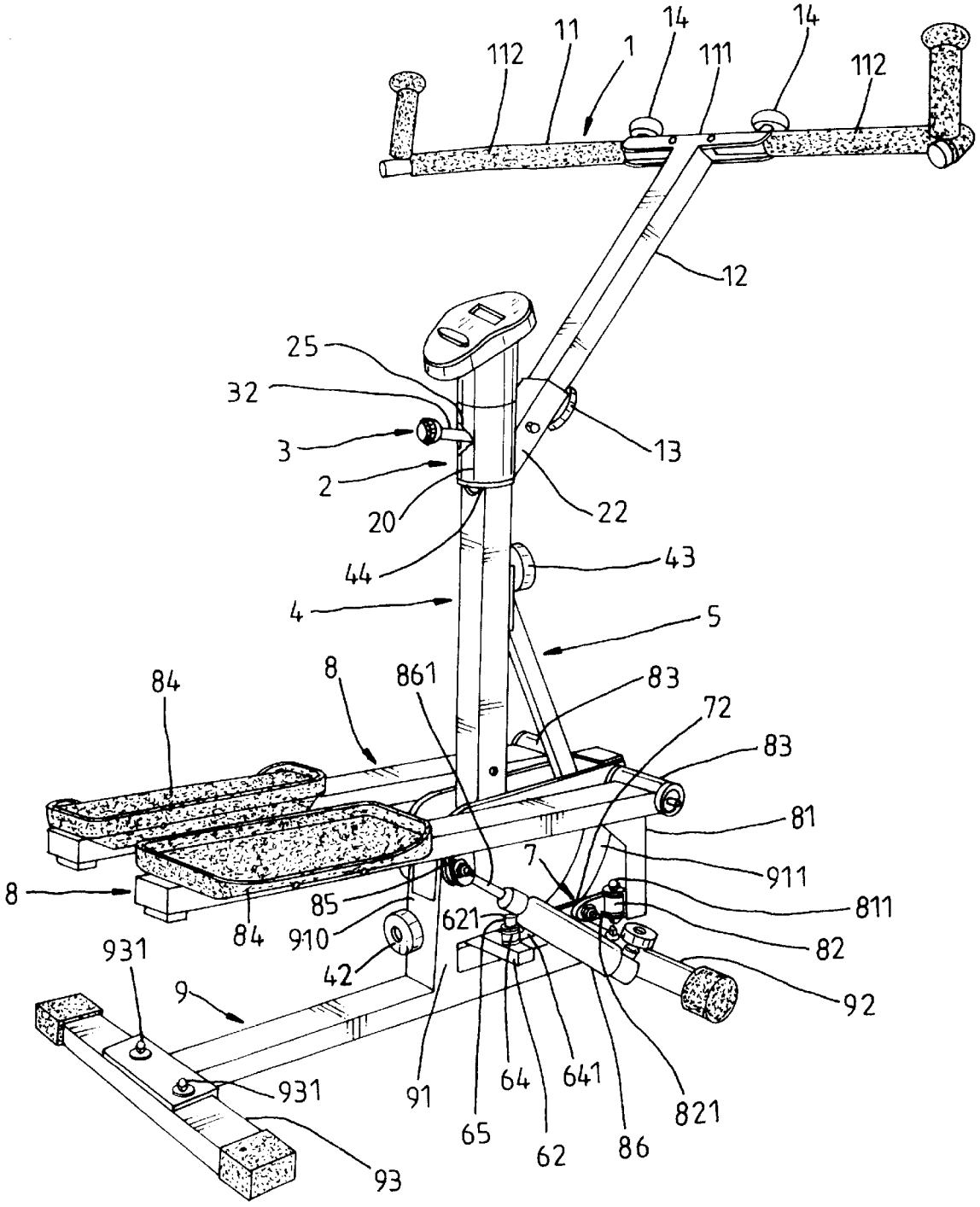
FIG. 1 is a perspective view of a climber according to the present invention.

Referring to Figures from 1 to 9, a climber in accordance with the present invention is generally comprised of a handlebar unit 1, a swivel holder 2, an adjustment bar 3, an upright support frame 4, a brace 5, a driven bar 6, two links 7, two pedal bars 8, two hydraulic cylinders 86, and a base frame 9.

The handlebar unit 1 comprises a handlebar 11, and a connecting bar 12 coupled to the handlebar 11. The connecting bar 12 is pivoted to the swivel holder 2, and then locked in the operative position by a lock screw 13, enabling the handlebar unit 1 to be turned with the swivel holder 2.

Figure 6:
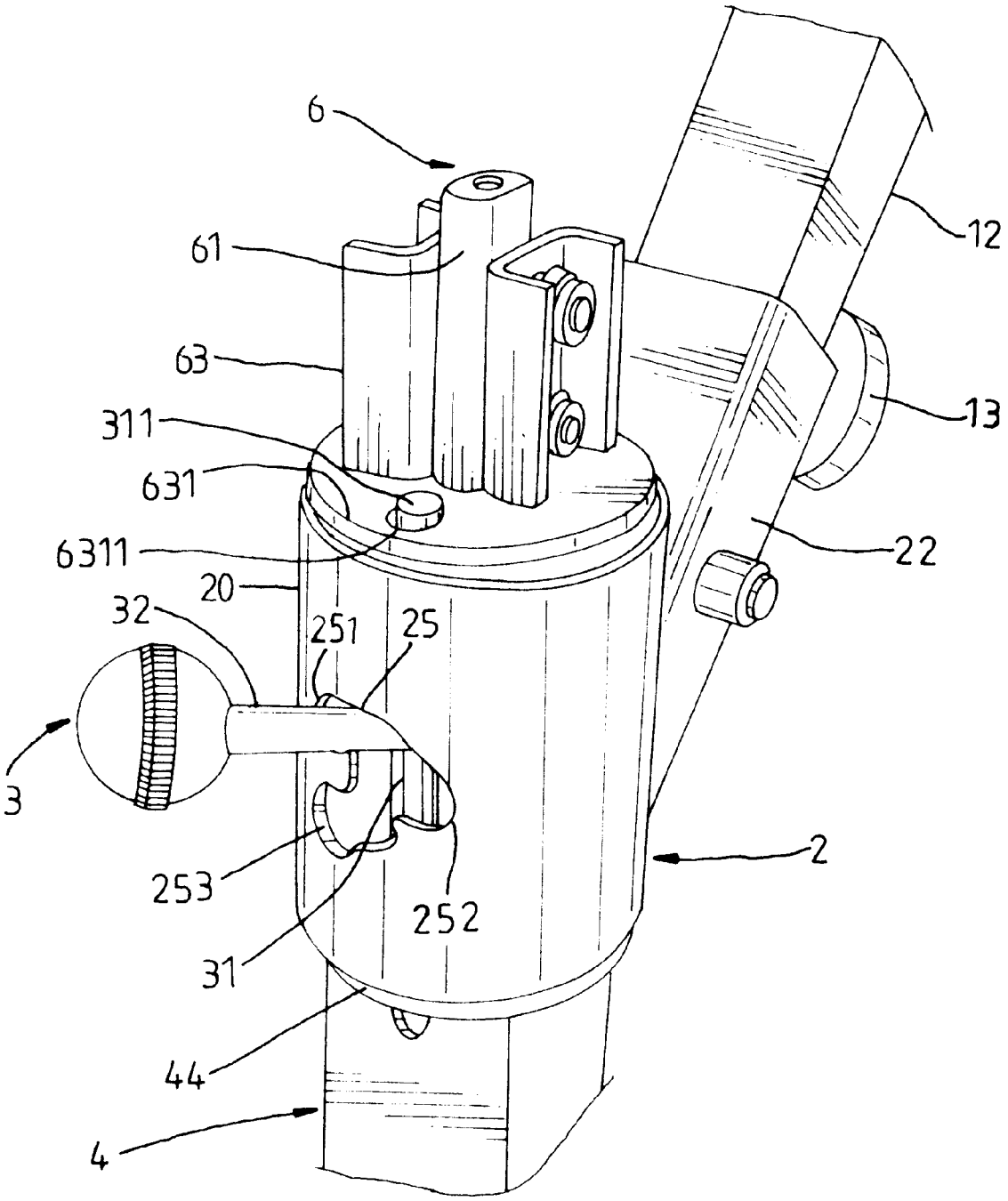
FIG. 6 is a perspective view in an enlarged scale of a part of the present invention, showing the headed horizontal rod of the adjustment bar retained to the upper locating notch on the swivel holder.

The swivel holder 2 comprises a hollow cylindrical holder base 20 turned about the vertical rod 61 of the driven bar 6 (see FIG. 9) above the upright support frame 4, and a coupling frame 22 obliquely upwardly raised from the holder base 20 to which the connecting bar 12 of the handlebar unit 1 is fastened by the lock screw 13. The holder base 20 is a hollow shell having a top wall 23 and a bottom wall 24. Axle holes 231; 241 are respectively provided at the top wall 23 and bottom wall 24 of the holder base 20 for receiving the top end 311 and bottom end 312 of the vertical rod 31 of the adjustment bar 3. An opening 25 is provided at the periphery of the holder base 20. The opening 25 defines an upper locating notch 251, an intermediate locating notch 252, and a lower locating notch 253 for the positioning of the adjustment bar 3 (see FIGS. 6, 7 and 8) The adjustment bar 3 comprises a vertical rod 31, a headed horizontal rod 32 perpendicularly connected to a middle part of the vertical rod 31 by for example a screw joint, and a compression spring 33 mounted around the vertical rod 31. The vertical rod 31 of the adjustment bar 3 is disposed inside the holder base 20 of the swivel holder 2 with its top and bottom ends 311; 312 respectively inserted into the axle holes 231; 241 on the top and bottom walls 23; 24 of the holder base 20. The headed horizontal rod 32 extends out of the holder base 20 of the swivel holder 2 through the opening 25 for operation by hand. The compression spring 33 is mounted around the vertical rod 31 and adapted to be stopped between the top wall 23 of the holder base 20 and the headed horizontal rod 32. The compression spring 33 imparts a downward pressure to the headed horizontal rod 32, enabling the headed horizontal rod 32 to be retained to one locating notch 251, 252 or 253.

Figure 4:
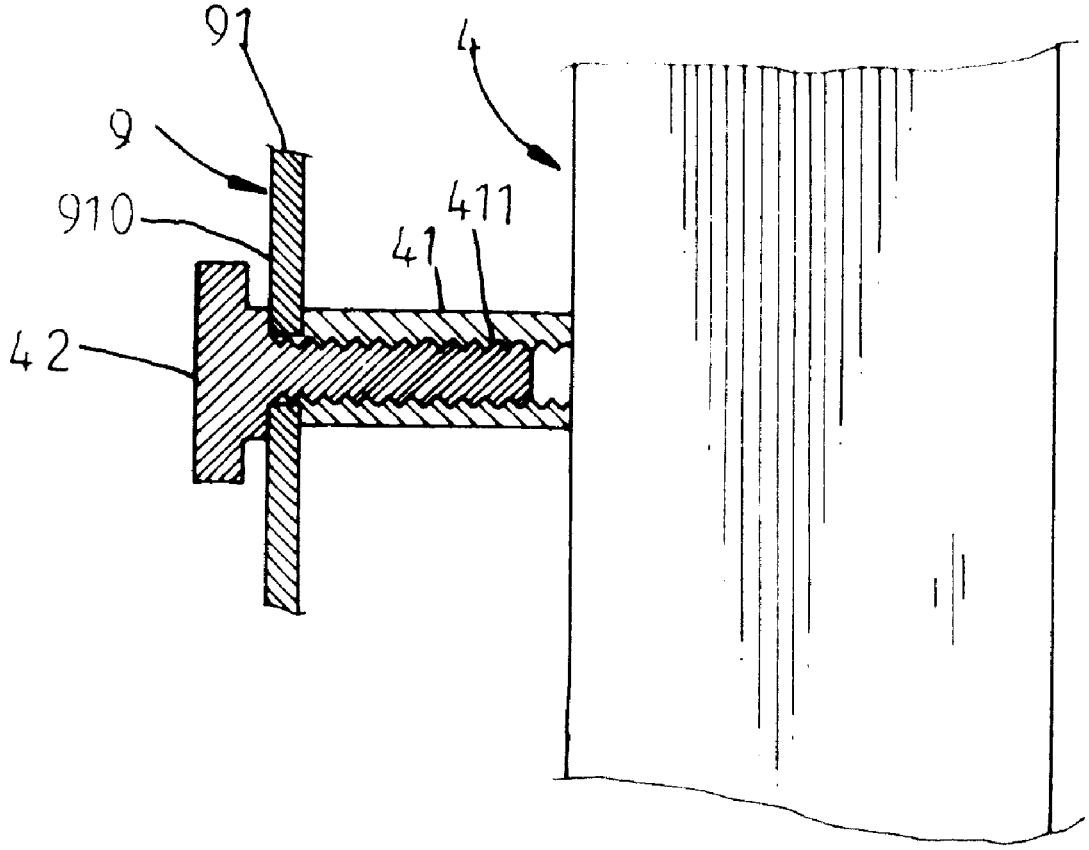
FIG. 4 is a sectional view in an enlarged scale of a part of the present invention, showing the upright support frame fastened to the upright casing of te base frame.

The upright support frame 4 is a hollow frame mounted around the vertical rod 61 of the driven bar 6, having a top side wall 44, a bottom side wall 45, and a mounting rod 41 raised from the periphery near the bottom end. The mounting rod 41 defines a screw hole 411. By threading a lock screw 42 through a through hole (not shown) on one upright casing 91 of the base frame 9 into the screw hole 411 on the mounting rod 41, the upright support frame 4 is secured to the base frame 9 (see FIG. 4). The top side wall 44 of the upright support frame 4 has a locating hole 441 in vertical alignment with the axle hole 241 on the bottom side wall 24 of the holder base 20 of the swivel holder 2 for receiving the bottom end 312 of the vertical rod 31 of the adjustment bar 3. Axle bearings 443; 453 respectively mounted in respective axle holes 442; 452 on the top and bottom side walls 44; 45 of the upright support frame 4 to support the verical rod 61 of the driven bar 6.

The brace 5 has a top end fastened to the upright support frame 4 by a first screw 43, and a bottom end pivoted to the upright casing 91 of the base frame 9.

The driven bar 6 comprises a vertical rod 61, a horizontal rod 62 integral with the bottom end of the vertical rod 61, and a control block 63 fixedly fastened to the top end of the vertical rod 61. The vertical rod 61 is revolvably supported in the axle bearings 443; 453 on the top and bottom side walls 44; 45 of the upright support frame 4. The top end of the vertical rod 61 extends out of the top side wall 44 of the upright support frame 4, and pivotably coupled to the top and bottom walls 23; 24 of the holder base 20 of the swivel holder 2. The control block 63 is fixedly fastened to the top end of the vertical rod 61, and suspended above the top wall 23 of the holder base 20 of the swivel holder 2 (see FIG. 6). The control block 63 has a bottom wall 631, and a locating hole 6311 at the bottom wall 631 in vertical alignment with the axle hole 231 on the top wall 23 of the holder base 20 of the swivel holder 2 for receiving the top end 311 of the vertical rod 31 of the adjustment bar 3. The two opposite ends of the horizontal rod 62 are respectively extended out of the upright casing 91 of the base frame 9. Two upright axles 621 are respectively integral with the horizontal rod 62 near its two opposite ends. Two coupling blocks 64 are respectively pivoted to the upright axles 621 by pivot pins 65. Each coupling block 64 comprises a lug 641.

The links 7 each have a first end 71 respectively pivoted to the lugs 641 of the coupling blocks 64 at the driven bar 6, and a second end 72 respectively pivoted to the pedal bars 8.

The pedal bars 8 are bilaterally pivoted to the upright casing 91 of the base frame 9, and respectively coupled to the links 7. Each pedal bar 8 comprises a rear end 83 pivoted to the upright casing 91 of the base frame 9 at one side, a rear end fixedly mounted with a foot plate 84, a downwardly extended lug 85 on the middle connected to the piston rod 861 of a respective hydraulic cylinder 86 being pivoted to the base frame 9 at one side, a downwardly extended rod 81 integral with the rear end 83, a coupling block 82 pivoted to a U-shaped flange 811 at the rod 81, and a lugs 821 provided at the coupling block 82 and pivoted to the second end 72 of one link 7.

The upright casing 91 of the base frame 9 comprises two arched slots 911 at two opposite vertical side walls thereof through which the ends of the horizontal rod 62 of the driven bar 6 extend out of the upright casing 91. The width of the arched slots 911 is greater than the diameter of the horizontal rod 62, so that the horizontal rod 62 can be moved along the arched slots 911. A horizontal rod 912 is provided at the upright casing 91, and extended out of two opposite upright side walls of the upright casing 91 to hold the hydraulic cylinders 86. The vertical front side wall 910 of the upright casing 91 is connected to the mounting rod 41 of the upright support frame 4. Furthermore, the transverse front bar 92 and transverse rear bar 93 of the I-shaped body of the base frame 9 are detachably locked by respective lock screws 921; 931.

The hydraulic cylinders 86 each comprise a fixed end 862 (namely, the cylinder block) coupled to the horizontal rod 912, and a movable end (namely, the piston rod) 861 respectively pivoted to the lugs 85 of the pedal bars 8.

When the user pedals the pedal bars 8 with the legs alternatively, the piston rods 861 of the hydraulic cylinders 86 are alternatively reciprocated, and the links 7 are alternatively moved back and forth with the pedal bars 8, causing the horizontal rod 62 of the driven bar 6 to be oscillated horizontally, and therefore the vertical rod 61 of the driven bar 6 is turned back and forth on its own axis. When the vertical rod 61 is turned back and forth on its own axis, the swivel holder 2 is driven to move synchronously, causing the handlebar unit 1 to make a reversed motion. Therefore, the user is forced to twist the waist when pedaling the pedal bars 8.

Figure 5:
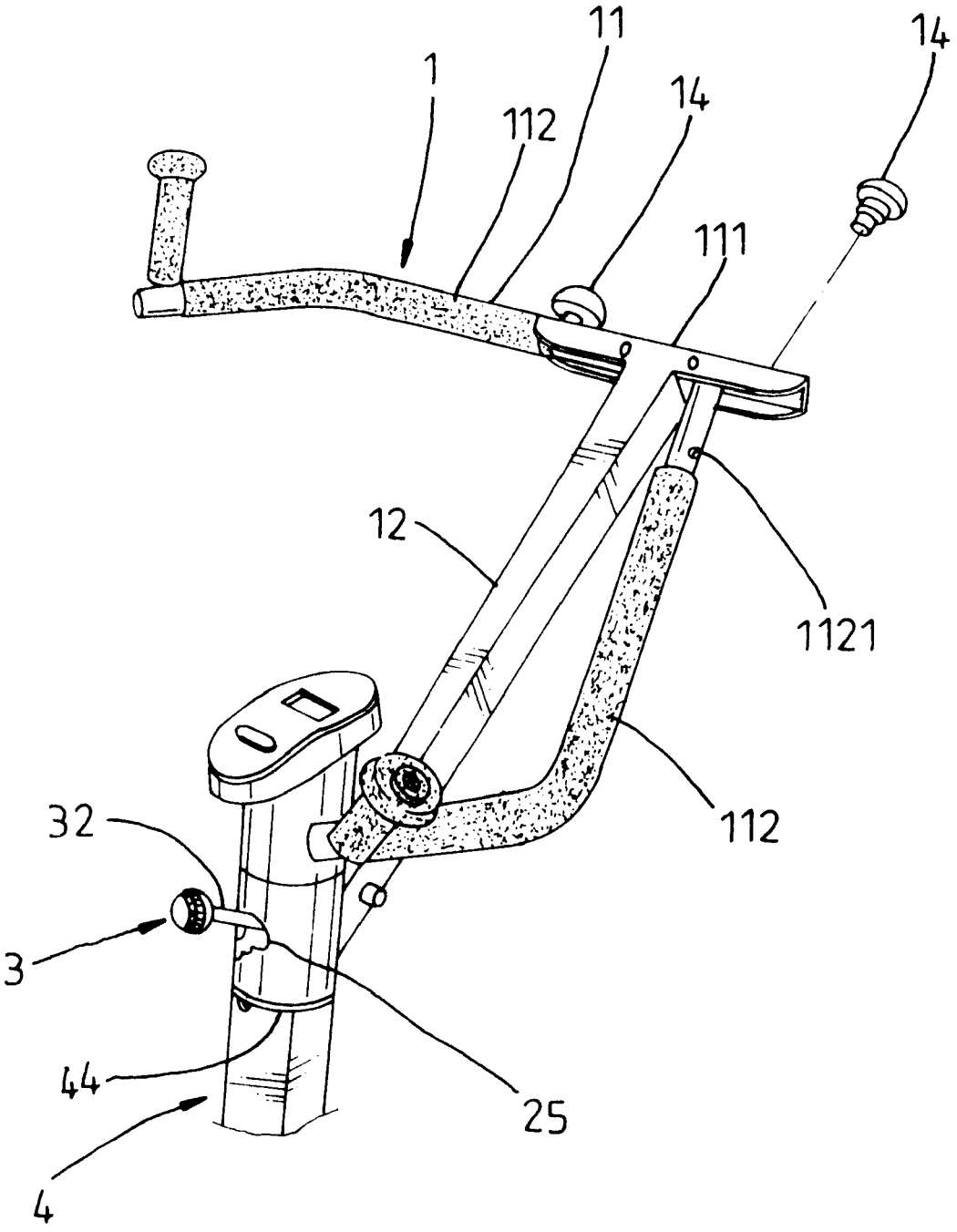
FIG. 5 is a perspective view of a part of the present invention, showing one hand grip of the handlebar unit collapsed.

The handlebar 11 of the handlebar unit 1 comprises a coupling frame 111 fixedly connected to one end of the connecting bar 12 remote from the swivel holder 2, and two hand grips 112 respectively pivoted to the coupling frame 111. The hand grips 112 each have a screw hole 1121 at one end. When the hand grips 112 are set into the operative position, lock screws 14 are respectively threaded through respective through holes (not shown) on the coupling frame 111 into the screw holes 1121 on the hand grips 112 to fix the hand grips 112 in place (see FIG. 5).

Figure 2:
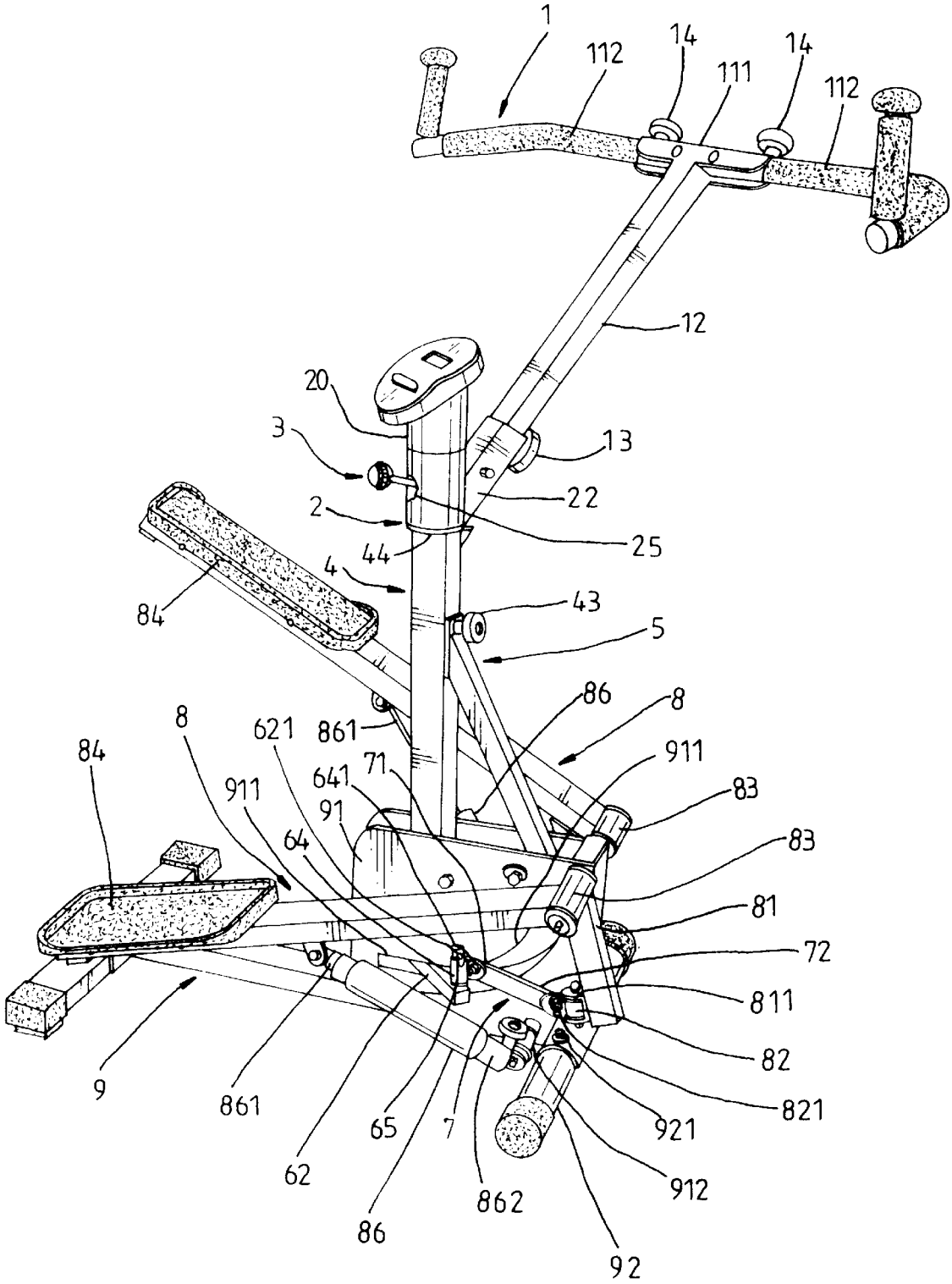
FIG. 2 shows the climber operated, the handlebar unit turned to one side according to the present invention.
Figure 3:
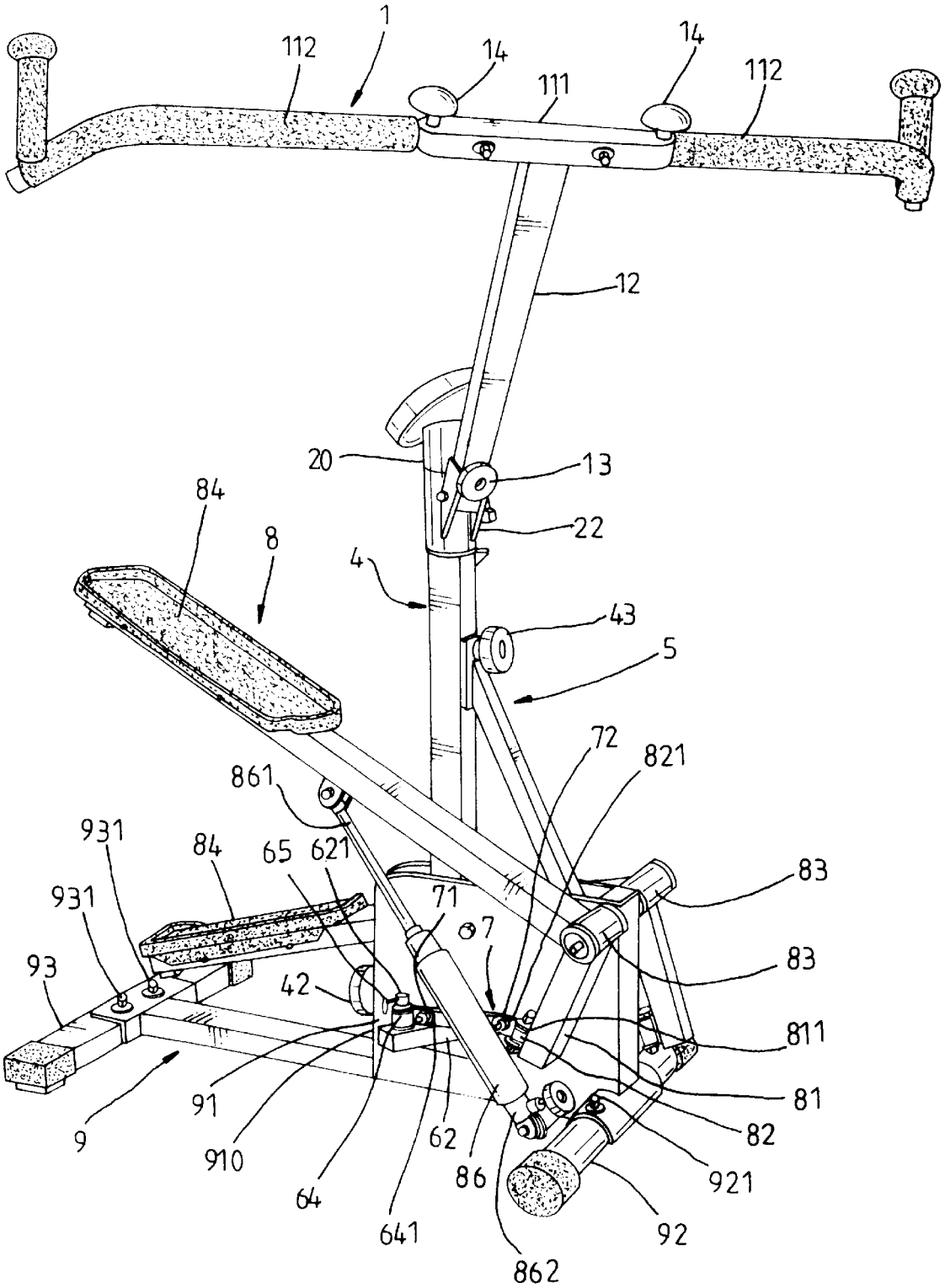
FIG. 3 shows the climber operated, the handlebar unit turned to the other side according to the present invention.
Figure 7:
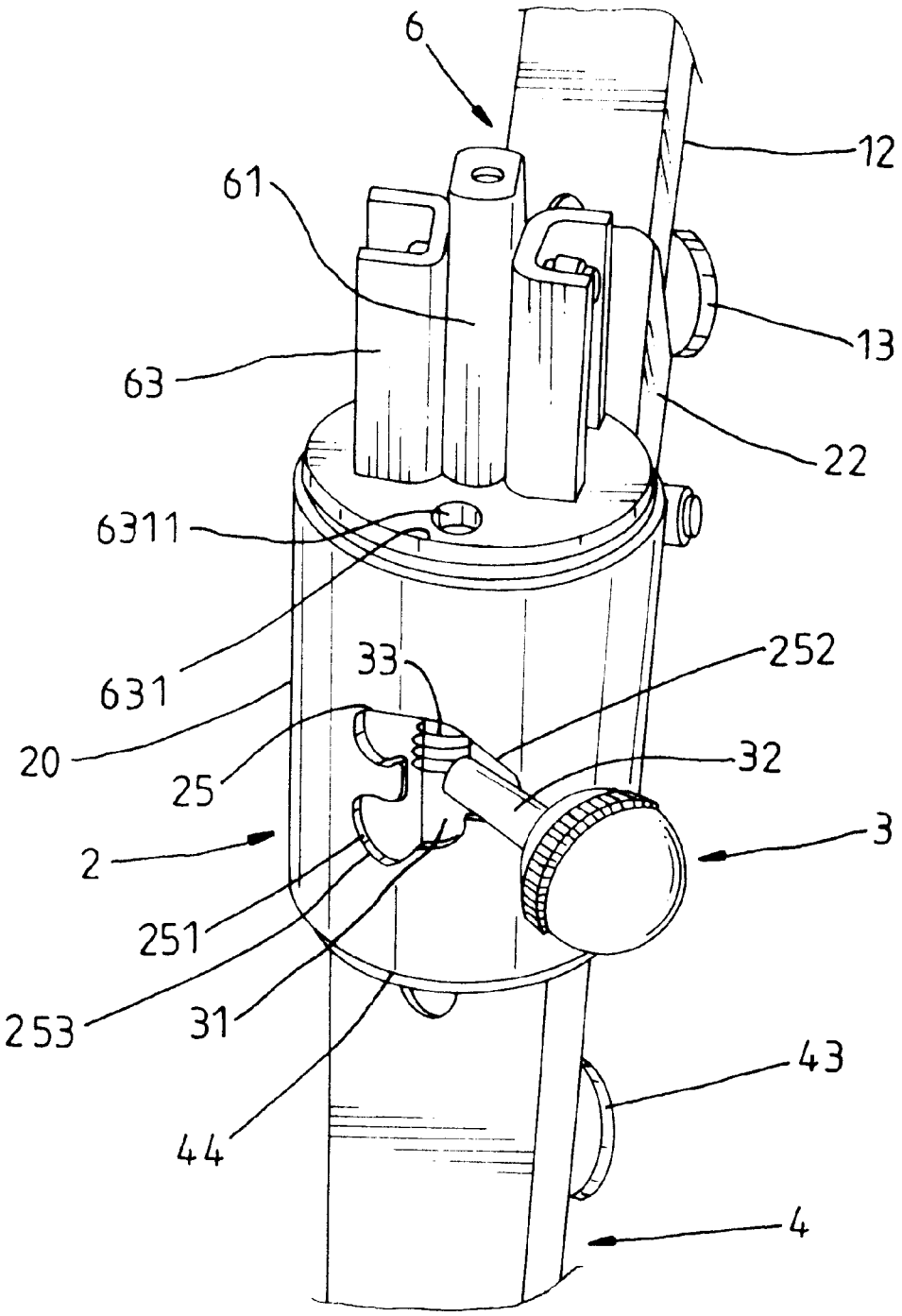
FIG. 7 is similar to FIG. 6 but showing the headed horizontal rod of the adjustment bar retained to the intermediate locating notch on the swivel holder.
Figure 8:
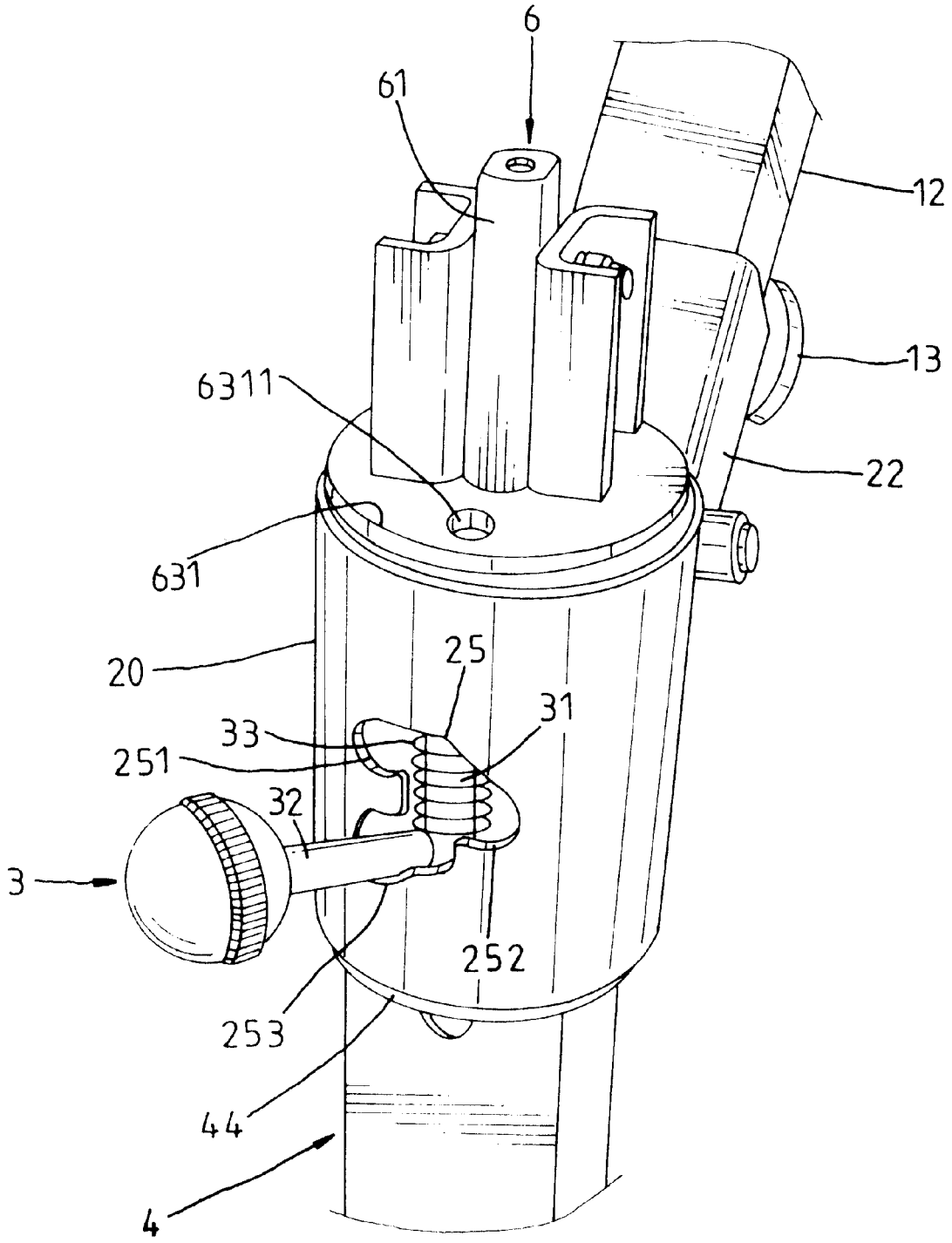
FIG. 8 is similar to FIG. 6 but showing the headed horizontal rod of the adjustment bar retained to the lower locating notch on the swivel holder.
Figure 9:
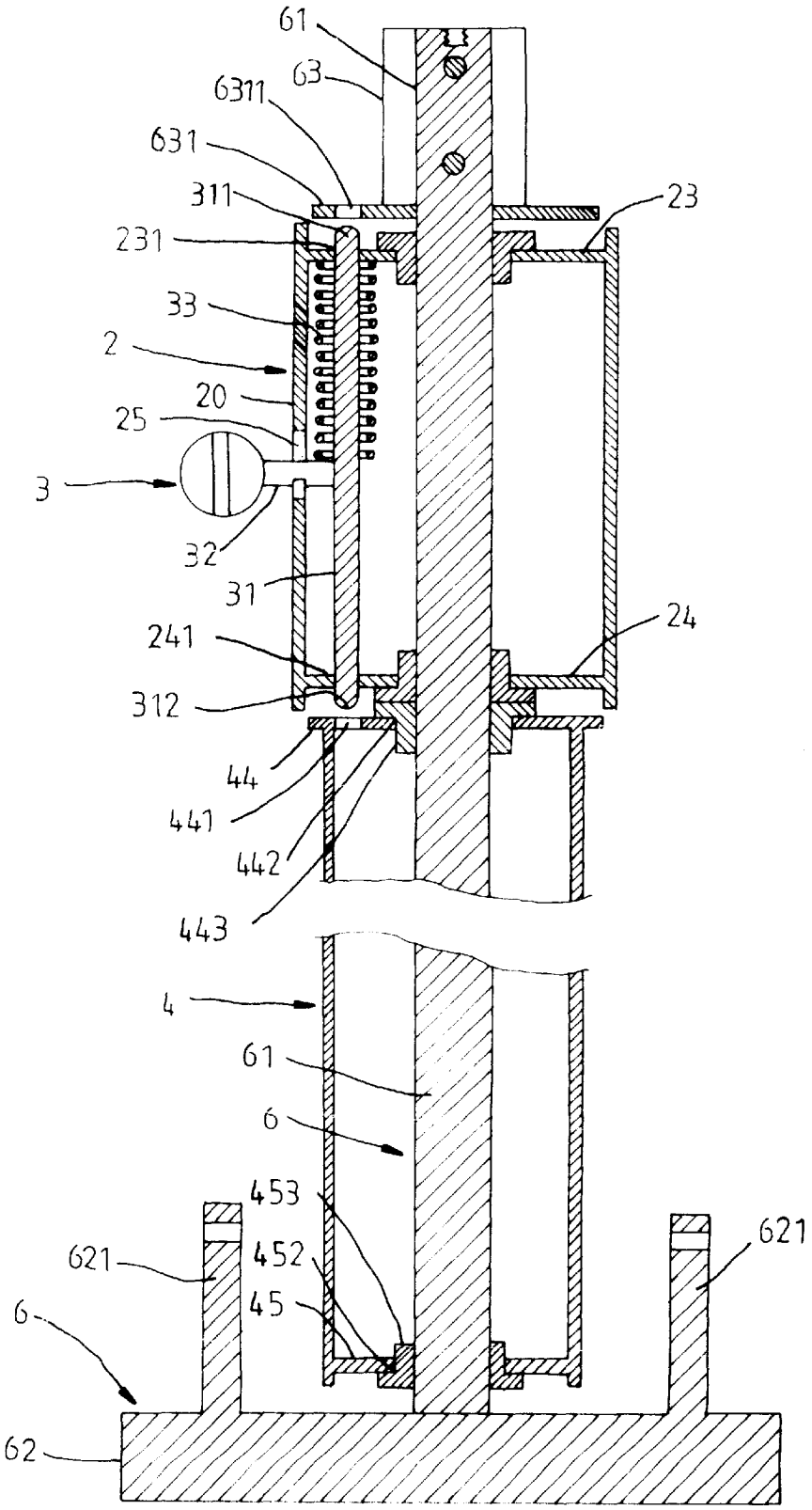
FIG. 9 is a sectional view in an enlarged scale of a part of the present invention, showing the upright support frame and the swivel holder coupled to the driven bar.

The adjustment bar 3 can be adjusted and retained to the upper locating notch 251, the intermediate locating notch 252 or the lower locating notch 253. When the headed horizontal rod 32 of the adjustment bar 3 is retained to the upper locating notch 251 (see FIG. 6), the top end 311 of the vertical rod 31 of the adjustment bar 3 is engaged into the locating hole 6311 on the bottom wall 631 of the control block 63 of the driven bar 6, and the handlebar unit 1 is forced to oscillate reversely when the driven bar 6 is turned back and force (see FIGS. 2 and 3). When the headed horizontal rod 32 of the adjustment bar 3 is retained to the intermediate locating notch 252 as shown in FIG. 7, the top end 311 and bottom end 312 of the vertical rod 31 are disengaged from the locating hole 6311 on the bottom wall 631 of the control block 63 of the driven bar 6 and the locating hole 441 on the top side wall 44 of the upright support frame 4 (see FIG. 9), therefore the handlebar unit 1 can be freely turned to the desired angle relative to the driven bar 6. When the headed horizontal rod 32 of the adjustment bar 3 is retained to the lower locating notch 253 as shown in FIG. 8, the bottom end 312 of the vertical rod 31 of the adjustment bar 3 is engaged into the locating hole 441 on the top side wall 44 of the upright support frame 4 to stop the swivel holder 2 from a rotary motion relative to the upright support frame 4.

Furthermore, when the climber is not in use, the lock screws 14 are removed from the coupling frame 111, enabling the hand grips 112 to be respectively turned inwards and closely attached to the connecting bar 12, then the lock screw 13 is removed from the connecting bar 12, enabling the connecting bar 12 with the collapsed handlebar 11 to be closely attached to the upright support frame 4, and then the lock screw 42 is removed from the upright support frame 4 and the pivot pins 65 are removed from the driven bar 6, enabling the upright support frame 4 and the driven bar 6 to be collapsed and closely attached to be base frame, and then the lock screws 921; 931 are respectively removed from the I-shaped body of the base frame 9, enabling the transverse front bar 92 and the transverse rear bar 93 to be dismounted.

We claim:

1. A climber comprising:

a base frame including:

an upright casing having two opposite upright side walls;

two arched slots on the two opposite upright side walls of said upright casing;

a horizontal locating rod mounted in said upright casing and having two opposite ends respectively extending out of the two opposite upright side walls of said upright casing;

a hollow upright support frame fastened to said base frame;

said hollow upright support frame including:

a horizontal top wall having a first centrally positioned hole and a first locating hole therein;

a horizontal bottom wall having a second centrally positioned hole therein and being in alignment with the first centrally positioned hole;

a vertical peripheral wall;

a mounting rod mounted within said vertical periphery wall and being detachably fastened to said upright casing of said base frame by a first lock screw;

a first axle bearing and a second axle bearing respectively mounted in the first and second centrally positioned holes on the horizontal top wall and the horizontal bottom wall of said hollow upright support frame;

a driven bar rotatable supported in said first axle bearing and said second axle bearing;

said driven bar including:

a vertical rod inserted through the first and second axle bearings;

the vertical rod of said driven bar having a top end and a bottom end respectively extending out of the horizontal top wall and the horizontal bottom wall of said upright support frame;

a horizontal rod mounted integrally with the bottom end of the vertical rod of said driven bar;

the horizontal rod of said driven bar having two opposite ends respectively extending out of the respective arched slot on said upright casing of said base frame;

a control block fixedly fastened to the top end of the vertical rod, said control block including:

a bottom wall; and a second locating hole at the bottom wall in vertical alignment with the first locating hole on the horizontal top wall;

two upright axles respectively mounted integrally with the ends of the horizontal rod of said driven bar outside said upright casing of said base frame;

and two coupling blocks respectively pivoted to said upright axles (621) by a respective pivot pin;

two pedal bars bilaterally pivoted to said upright casing of said base frame, each of said pedal bars including:

a rear end pivoted to said upright casing at one side, a front end fixedly mounted with a foot plate;

a downwardly extended lug being provided at a median portion of the pedal bar;

a downwardly extended rod mounted integrally with the rear end of the pedal bar;

a coupling block pivoted to a U-shaped flange at the downwardly extended rod of the pedal bar; and a lug member being provided at the coupling block at the downwardly extended rod of the pedal bar;

two links each including:

a first end respectively pivoted to the lug member of the coupling block of said driven bar; and a second end respectively pivoted to the lug member at the coupling block of said pedal bar;

two hydraulic cylinders coupled between the two ends of the horizontal locating rod of said base frame and said pedal bars;

each of said hydraulic cylinders including:

a fixed end pivoted to the horizontal locating rod of said base frame; and a movable end respectively pivoted to the downwardly extended lug at the median portion of the pedal bar;

a swivel holder mounted around the vertical rod of said driven bar and spaced between said upright support frame and said control block;

said swivel holder including:

a hollow cylindrical holder base rotatable with the vertical rod of said driven bar; and a frame unit mounted obliquely in an upwardly manner and fixedly attached to said holder base;

said holder base including:

a horizontal top wall member having a first axle hole; and a horizontal bottom wall member having a second axle hole in alignment with the first axle hole;

a peripheral side wall; and an opening on the peripheral side wall of said holder base;

said opening defining an upper locating notch, an intermediate locating notch, and a lower locating notch;

a handlebar unit including:

a handlebar; and a connecting bar having one end connected to said handlebar and an opposite end pivoted to the coupling frame of said swivel holder and locked by a second lock screw; and an adjustment bar mounted in said swivel holder;

said adjustment bar including:

a vertical rod mounted in said holder base of said swivel holder;

a headed horizontal rod perpendicularly connected to a median portion of the vertical rod of said adjustment bar and extending out of the opening of said holder base of said swivel holder;

and a compression spring mounted around the vertical rod of said adjustment bar and being adapted for stopping between the headed horizontal rod of said adjustment bar and the horizontal top wall of said holder base of said swivel holder;

the vertical rod of said adjustment bar having top and bottom ends respectively inserted into the axle holes on the horizontal top and bottom walls of said holder base of said swivel holder;

said compression spring imparting a downward pressure to the headed horizontal rod of said adjustment bar;

said adjustment bar being movable among the following positions:

a first position wherein said headed horizontal rod of said adjustment bar is retained to said upper locating notch and the top end of the vertical rod of said adjustment bar is engaged into the first locating hole on the bottom wall of said control block of said driven bar, enabling said handlebar unit to oscillate when said driven bar is oscillated during the operation of said pedal bars;

a second position wherein said headed horizontal rod of said adjustment bar is retained to the intermediate locating notch and the top end and bottom end of the vertical rod of said adjustment bar are disengaged from the first locating hole on the bottom wall of said control block of said driven bar and the second locating hole on the horizontal top wall of said upright support frame, enabling said handlebar unit to be freely turned to the desired angle relative to said driven bar;

and a third position wherein the headed horizontal rod of said adjustment bar is retained to said lower locating notch and the bottom end of the vertical rod of said adjustment bar is engaged into the second (axle) locating hole on the horizontal top wall of said upright support frame (4) to stop said swivel holder from a rotary motion relative to said upright support frame.

2. The climber of claim 1, wherein the coupling frame of the handlebar of said handlebar unit is fixedly connected to one end of the connecting bar of said handlebar unit and being remote from said swivel holder, and includes two hand grips respectively pivoted to said coupling block and being locked by the respective second lock screw.

* * * * *